US005400872A

United States Patent [19]

Skalski et al.

[11] Patent Number: 5,400,872

[45] Date of Patent: * Mar. 28, 1995

[54] COUNTERACTING HORIZONTAL ACCELERATIONS ON AN ELEVATOR CAR

[75] Inventors: Clement A. Skalski, Avon; John K. Salmon, South Windsor; Richard L. Hollowell, Amston, all of Conn.

[73] Assignee: Otis Elevator Company, Farmington, Conn.

[ * ] Notice: The portion of the term of this patent subsequent to Mar. 15, 2011 has been disclaimed.

[21] Appl. No.: 50,742

[22] Filed: Apr. 20, 1993

Related U.S. Application Data

[63] Continuation of Ser. No. 555,135, Jul. 18, 1990, abandoned.

[51] Int. Cl.[6] ..... B66B 1/44

[52] U.S. Cl. ..... 187/393; 187/414

[58] Field of Search ..... 187/9 S, 1 R, 11 S, 187/109, 73

[56] References Cited

U.S. PATENT DOCUMENTS 3,099,334 7/1963 Tucker et al. ..... 187/95

3,669,222 6/1972 Takamura et al. ..... 187/95

(List continued on next page.)

FOREIGN PATENT DOCUMENTS 0033184 8/1981 European Pat. Off. ..... B66B 7/04

(List continued on next page.)

OTHER PUBLICATIONS

"Inertial Profilometer as a Rail Surface Measuring Instrument" by T. J. Rudd and E. L. Brandenburg published by ASME, Sep. 1973.

"Development Of An Inertial Profilometer" by E. L. Brandenburg et al. Published by National Technical Information Service (U.S. Dept. of Commerce) Nov. 1974.

*NASA Tech Briefs*, "Flux-Feedback Magnetic-Suspension actuator" Publ. Jul. 1990, pp. 44–45.

*Popular Science*, Sep. 1990 "Riding on Electrons" by Don Sherman pp. 74–77.

Patent Abstracts of Japan (JAPIO)—Kokai 3-88690 English abstract publication date unknown.

Patent Abstracts of Japan (JAPIO)—Kokai 3-88687 English abstract publication date unknown.

"A Magnetic Bearing Control Approach using Flux Feedback" by N. Groom, published Mar. 1989 in *NASA Technical Memorandum 100672.*

Skalski, C. A. "Performance of Magnetic Suspensions for High Speed Vehicles Operating over Flexible Guideways" Jun. 1974 *Journal of Dyanamic Systems, Meas. & Control.*

*Primary Examiner*—Steven L. Stephan

*Assistant Examiner*—Robert Nappi

*Attorney, Agent, or Firm*—Francis J. Maguire, Jr.

[57] ABSTRACT

A method and apparatus for actively counteracting a disturbing force acting on a suspended elevator cab in a frame moving vertically in a hoistway is disclosed. A manifestation of the disturbing force such as acceleration is sensed and counteracted, for example, by effectively adding mass to the cab in proportion to the sensed acceleration. This may be accomplished by using an electromagnet actuator for actuating the suspended cab in response to a control signal from a control means which is in turn responsive to the sensed signal. Whatever type of actuator is used, it may be used as well to bring the suspended cab to rest with respect to a hoistway sill prior to transferring passengers. The control means may be analog or digital or a combination of both. A preferred analog-digital approach is disclosed in which the digital part is responsive to accelerometer signals, the analog part is responsive to a force command signal from the digital part and provides a position feedback signal in return. In a preferred embodiment, four electromagnet actuators are situated in the corners of the cab between the floor of the frame and the bottom of the suspended cab. Each actuator may act along a line which intersects the walls of the cab at a forty-five degree angle. A single axis embodiment is also disclosed.

21 Claims, 13 Drawing Sheets

U.S. PATENT DOCUMENTS

| | | | |
|---|---|---|---|
| 3,939,778 | 2/1976 | Ross et al. | 105/182.1 |
| 4,215,403 | 7/1980 | Pollard et al. | 364/424.05 |
| 4,621,833 | 11/1986 | Soltis | 280/707 |
| 4,625,993 | 12/1986 | Williams et al. | 280/707 |
| 4,642,501 | 2/1987 | Kral et al. | 310/90.5 |
| 4,750,590 | 6/1988 | Otala | 187/95 |
| 4,754,849 | 6/1988 | Ando | 187/95 |
| 4,770,438 | 9/1988 | Sugasawa et al. | 280/707 |
| 4,809,179 | 2/1989 | Klinger et al. | 364/424.05 |
| 4,892,328 | 1/1990 | Kurtzman et al. | 280/707 |
| 4,898,257 | 2/1990 | Brandstadter | 180/9.1 |
| 4,899,852 | 2/1990 | Salmon et al. | 187/1 R |
| 4,909,535 | 3/1990 | Clark et al. | 280/707 |
| 5,020,639 | 6/1991 | Michel | 187/1 R |
| 5,027,925 | 7/1991 | Kahkipuro et al. | 187/115 |
| 5,086,882 | 2/1992 | Sugahara et al. | 187/95 |

FOREIGN PATENT DOCUMENTS

| | | | |
|---|---|---|---|
| 0467673 | 1/1992 | European Pat. Off. | B66B 11/02 |
| 58-39753 | 9/1983 | Japan | B66B 7/02 |
| 60-15374 | 1/1985 | Japan | B66B 1/06 |
| 60-36279 | 2/1985 | Japan | B66B 7/04 |
| 61-22675 | 6/1986 | Japan | B66B 7/08 |
| 63-45768 | 3/1988 | Japan | B66B 13/06 |
| 63-87483 | 4/1988 | Japan | B66B 1/06 |
| 1-156293 | 6/1989 | Japan | B66B 11/02 |
| 1-197294 | 8/1989 | Japan | B66B 7/04 |
| 1-288591 | 11/1989 | Japan | B66B 11/08 |
| 2-3891 | 1/1990 | Japan | G08B 17/107 |
| 2-127373 | 5/1990 | Japan | B66B 1/26 |
| 2-198997 | 8/1990 | Japan | B66B 11/08 |
| 3-88687 | 4/1991 | Japan | B66B 7/04 |
| 3-88690 | 4/1991 | Japan | B66B 11/02 |
| 2238404 | 5/1991 | United Kingdom | B66B 7/02 |

COUNTERACTING HORIZONTAL ACCELERATIONS ON AN ELEVATOR CAR

This is a continuation of application Ser. No. 07/555,135, filed on Jul. 18, 1990, which designated the U.S., now abandoned.

RELATED APPLICATIONS

This application discloses subject matter which may be disclosed and claimed in commonly owned, copending applications U.S. Ser. No. (07/555,181), entitled "Plural Bladed Rail" U.S. Ser. No. (07/555,140), entitled "Elevator Rotational Control" U.S. Ser. No. (07/555,140), entitled "Y-Shape Section for Elevator Guide Rail" U.S. Ser. No (07/555,130), entitled "Active Control of Elevator Platform", and U.S. Ser. No (07/555,132) entitled "Elevator Active Suspension System".

1. Technical Field

This invention relates to elevators and, more particularly, to a pendulum car.

BACKGROUND ART

In a non-pendulum car disclosure, U.S. Pat. No. 4,754,849, Hiroshi Ando shows electromagnets disposed outside the car symmetrically about guide rails in a control system using opposing forces from the electromagnets to keep the car steady using the rails as the necessary ferromagnetic mass but, rather than using the rails as a straight reference line, instead using a cable stretched between the top and bottom of the hoistway. The position of the car with respect to the cable is controlled using detectors in a closed loop control system. There is serious question as to whether such a cable can be successfully used as a reliable guide of straightness. Moreover, the Ando disclosure requires the use of twelve electromagnets with separate control and power circuits. Furthermore, the use of guide rails such as are disclosed by Ando will require fairly massive coils in order to generate the large amount of flux density required, given the (i) not insignificant force required to move the weight of the elevator cab, (ii) the necessarily small utilizable surface area on the rail, and (iii) the relatively large airgap required as compared to the rail thickness.

In another non-pendulum car disclosure, U.S. Pat. No. 4,750,590, Matti Otala discloses what appears to be an essentially open loop control system with solenoid actuated guide shoes that uses the concept of memorizing the out-of-straightness of the guide rails for storage in a computer memory and then sensing the position of the car in the hoistway for the purpose of recalling the corresponding information from memory and correcting the guide rail shoe positions accordingly. An acceleration sensor is mentioned in claim 6 but does not appear to be otherwise disclosed as to its purpose in the specification or drawing. Perhaps it is used to determine the acceleration of the car in the hoistway. Such an acceleration signal would presumably be needed to determine which data point to retrieve from memory as suggested in claim 2. Otala's approach suffers from the problem of changes in the out-of-straightness before a correction run can be effected and the accuracy with which the stored information can be made to conform to the car's actual position.

A mounting arrangement for a pendulum or hung car is shown in U.S. Pat. No. 4,113,064 by Shigeta et al wherein the cab is suspended within and from the top of an outer framework by a plurality of rods connected to the bottom of the cab. A plurality of stabilizing stoppers are shown interposed between the underside of the hung cab and the floor of the frame. Each stopper comprises a cylinder extending downward from the underside of the hung cab surrounding a rubber torus placed on an upright rod extending from the floor of the frame. Clearance between the cylinder and the cab is sufficient to permit movement but insufficient to allow the cab to strike the frame. Another embodiment comprising bolster means having ball bearings permits movement in any direction of the horizontal plane.

Another approach is disclosed by Luinstra et al in U.S. Pat. No. 4,660,682 wherein a pair of parallel rails are arranged horizontally in a parallelogram between the suspended cab and frame with followers farranged to roll or slide on the rails in such a way that the cab can move in any horizontal direction relative to the frame.

Both of the last two pendulum car approaches employ passive restraints on movement which by nature are reactive rather than active.

DISCLOSURE OF THE INVENTION

An object of the present invention is to provide an active control for the suspension of an elevator pendulum car.

According to the present invention, a cab suspended in a frame undergoing vibrations in moving up and down an elevator hoistway is controlled with respect to a selected parameter by a plurality of actuators in a closed loop control system responsive to a plurality of sensors for detecting the selected or another, related parameter. Such parameters may include position, velocity, acceleration, vibration or other similar parameters.

In further accord with the present invention, the actuators are arranged so as to counteract translational forces acting on the cab.

In still further accord with the present invention, the actuators are arranged so as to counteract rotational forces acting on the cab.

In accordance still further with the present invention, the actuators may be of the electromagnetic type.

In further accord with the present invention, a preferred embodiment utilizes four electromagnetic actuators each operating along an axis which is disposed at an angle of 45 degrees to the planes of the cab walls.

The present invention recognizes that Ando's twelve electromagnets of relatively large size for moving an entire elevator car can be replaced by a lesser number of electromagnets of relatively small size for instead moving a cab suspended within a frame. This approach has the added advantage of greatly simplifying the design. Moreover, there is then no need to use Ando's cable which may be subject to out-of-straightness forces due to many factors such as building sway, expansion and contraction due to temperature changes, vibrations due to air currents in the hoistway and other causes, etc. Such a construct can be replaced, according to a preferred embodiment of the present invention by accelerometers used to provide signals which can be indicative of position in a closed loop control system.

Although I teach that a position control system based on an accelerometer output is a superior approach, I also recognize that drift is associated with the accelerometers which I teach may be corrected, preferably based on a slow regulating loop to control the average cab position with respect to a fixed referent.

Thus, in further accord with the present invention, a preferred embodiment of the present invention comprises a relatively fast, simple, analog control loop responsive to accelerometers with one or more, relatively slower, but more accurate, digital control loops responsive to position or acceleration sensors or to both.

As previously suggested, the passive restraints employed by Shigeta et al and Luinstra et al are not as effective as the present invention in that they do not actively counteract the undesirable translational and rotational forces to which the car is subjected and thus do not provide as smooth a ride for the passenger as that provided by the present invention.

In the co-pending applications cited at the beginning of the specification, several active suspension inventions are disclosed which describe embodiments of those inventions which include separate, single-axis controls, such as disclosed herein in connection with FIGS. 5, 11, 12 and 18, and which applications also describe combined, i.e., coupled, multi-axis control channels. Since a single-axis control may be used in practicing the presently claimed invention, we hereby incorporate those documents by reference as alternate embodiments. It should be understood that the separate, single-axis controls disclosed in detail in several of the co-pending applications are advantageous for simplicity of design and for the advantage of being able to electronically decouple the various control axes. It will be noted, however, that the approach disclosed herein is somewhat less expensive than the single-axis approach, because of the added number of electromagnets required in the multi-axis approach. On the other hand, there are only three channels of electronics required in the separate channels, while the combined, multi-axis approach disclosed herein in detail requires a minimum of four channels of electronics.

These and other objects, features and advantages of the present invention will become more apparent in light of the following detailed description of a best mode embodiment thereof, as illustrated in the accompanying drawings.

BEST MODE FOR CARRYING OUT THE INVENTION

Figure 1A:
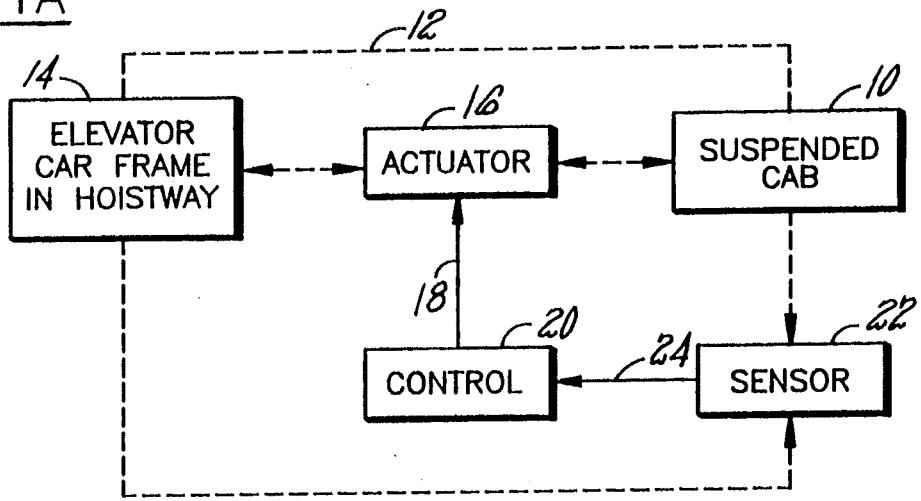
FIG. 1A is a simplified block diagram of a preferred embodiment of an active control system for a pendulum (suspended) car, according to the present invention.

In FIG. 1A, an elevator cab 10 is suspended by means 12, for example metal rods, from an elevator car frame 14 which is disposed for up and down travel in an elevator hoistway guided by means such as rails attached to the hoistway walls. The end of the suspension attached to the car moves with the frame as it undergoes small translational and rotational movements in the hoistway and the car will be jostled and will also sway. According to a preferred embodiment of the present invention, to counteract such jostling and swaying, an actuator 16 is disposed in between the cab 10 and frame 14 for imparting forces thereto in response to a control signal 18 from a control 20. A plurality of sensors 22 is responsive to one or more selected parameters indicative of translational and rotational movements of the cab which cause it to deviate from staying perfectly centered on an imaginary line through the center of the hoistway. The sensors 22 may be responsive to any one or any number of selected parameters such as the position of the cab with respect to the frame, the translational accelerations experienced by the cab, etc. The sensors 22 provide one or more sensed signals on a line 24 to the control 20 in order to complete a closed loop for automatic feedback control.

Figure 1B:
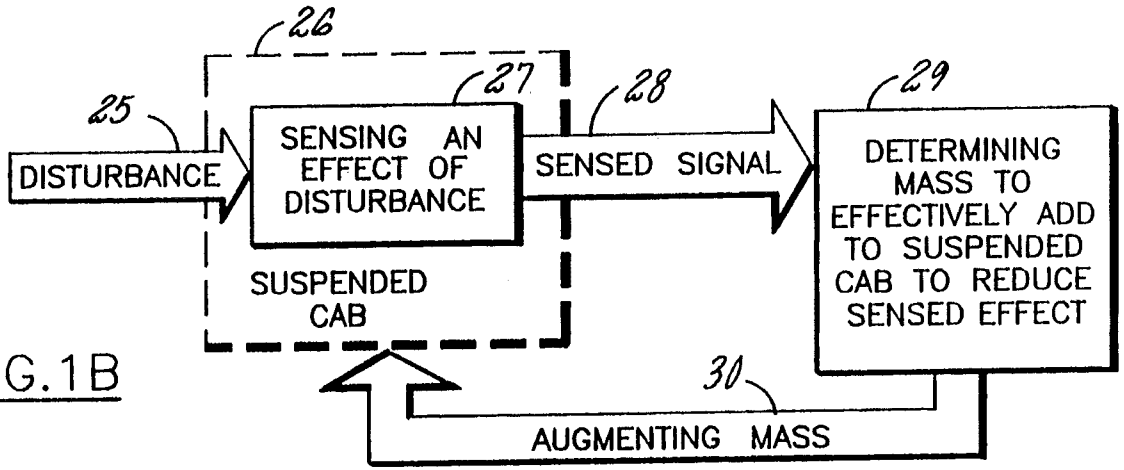
FIGS. 1B–1D are a simplified block diagrams of methods for carrying out the invention.

The methodology for effecting the above may be illustrated abstractly as shown in FIG. 1B where a disturbance on a line 25 creates an effect on a suspended cab 26 which is sensed in a step 27. A sensed signal is provided on a line 28 and, in response thereto, the mass needed to effectively add to the cab to reduce the sensed effect is determined in a step 29 and the determined mass is effectively added to the cab as shown by a signal on a line 30.

Figure 1C:
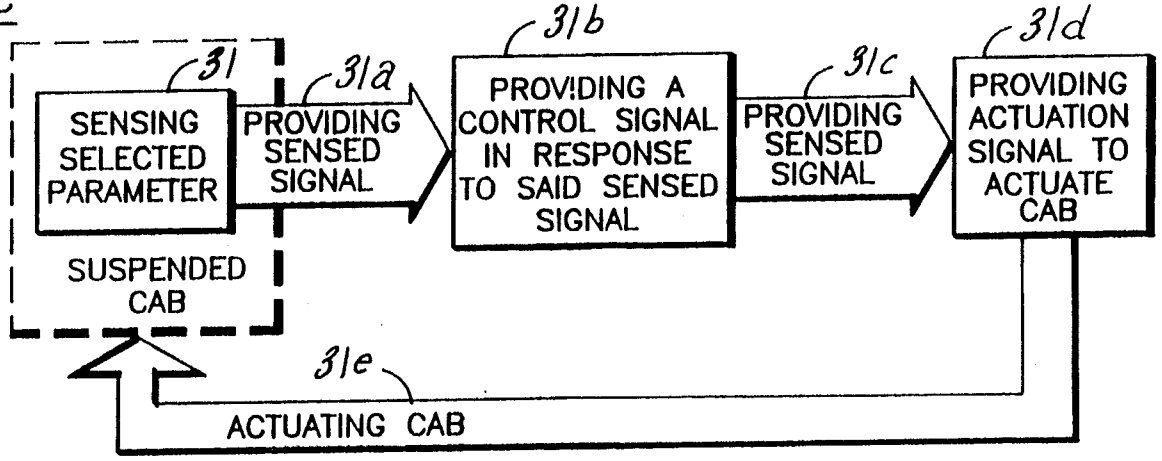

A similar method is also shown in FIG. 1C where a selected parameter is sensed in a step 31 and a sensed signal provided on a line 31*a*. In response to the sensed signal, a control signal is generated in a step 31*b* and provided on a line 31*c*. The cab is then actuated as indicated in a step 31*d* by providing an actuating signal on a line 31*e*.

Figure 1D:
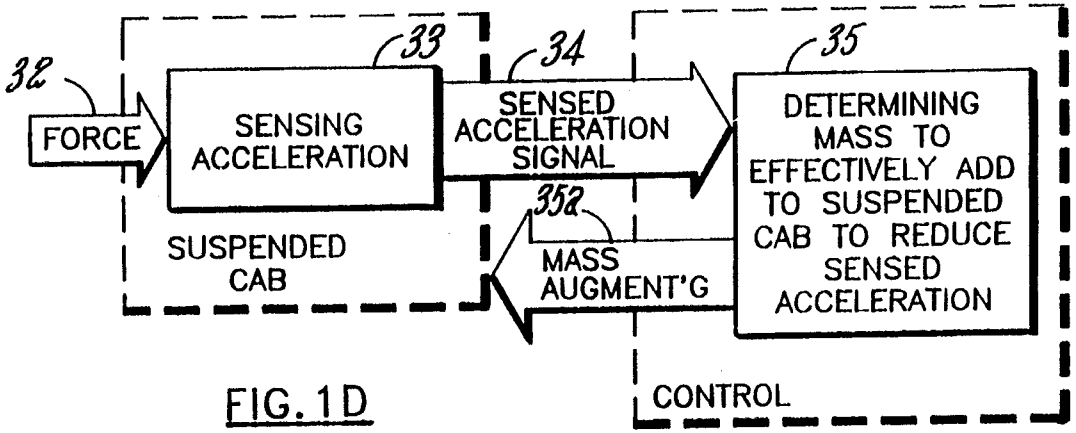

A preferred approach is to sense the acceleration produced in a suspended cab by a disturbing force 32 as shown in a step 33 in FIG. 1D. A sensed acceleration signal is provided on a line 34 to a control where a determination is made in a step 35 as to the magnitude of the mass required to effectively add to the suspended cab to reduce the sensed acceleration. A mass augmenting signal is then provided on a line 35*a* at the determined magnitude.

Figure 2:
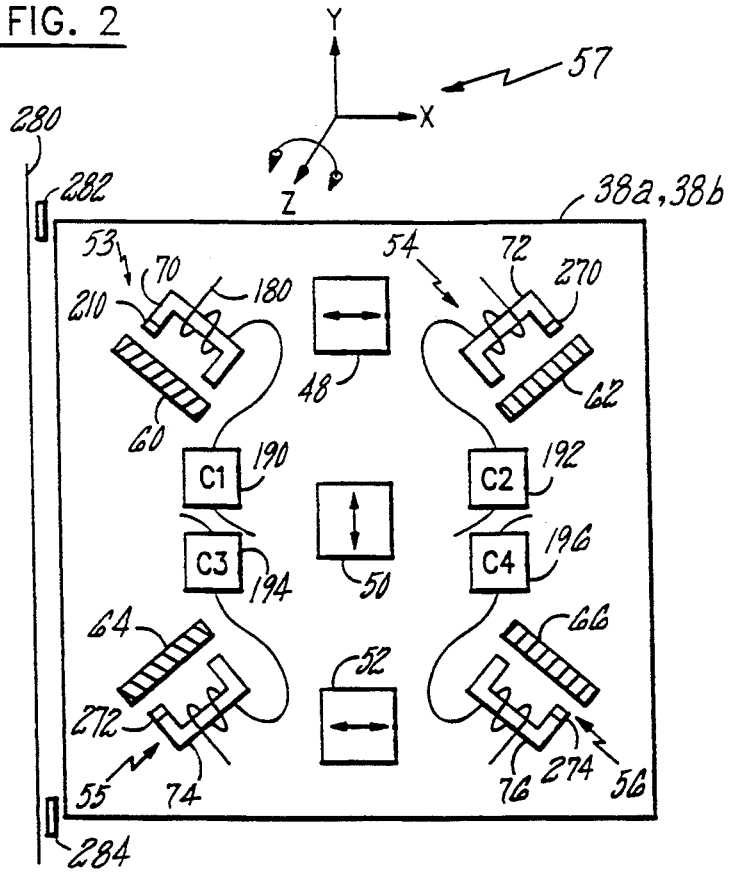
FIG. 2 is a plan view of a plurality of actuators employed to control the position of the suspended cab within a car frame according to a means for carrying out the preferred embodiment of the present invention.

In FIG. 2, a floor 38*a* of the frame 14 and a bottom 38*b* of the cab 10 are superimposed and are presented in a plan view which shows the two in registration at rest. For descriptive purposes and not by way of limitation, if one assumes a rectangular or, for simplicity, a square layout for the frame floor 38*a* and cab bottom 38*b*, one can visualize a pair of reaction planes perpendicular to the floor 38*a* and bottom 38*b* which intersect one another along a vertical cab centerline which perpendicularly intersects the center of the square. The reaction planes may or may not intersect the floor and bottom along the bottom's (and floor's) diagonals.

One way to view the preferred embodiment of the invention is to think of the control system as causing the elevator cab's centerline to remain coincident with an imaginary reference line up the center of the hoistway without the suspended cab rotating about the coincident cab and hoistway centerlines.

It does this by the use of cab-mounted accelerometers 48, 50, 52 which together are used to sense accelerations manifesting small translational deviations of the cab's centerline from the hoistway's centerline and by further sensing accelerations manifesting small rotations of the cab about the hoistway centerline and by the selective use of actuators 53, 54, 55, 56, exerting forces perpendicular to the reaction planes to maintain the desired centerlines' coincidence with no rotation. A three dimensional coordinate system illustration 57 in FIG. 2 has its x-y plane in the paper and should be thought of as having its origin in the center of the square 38 and having its z-axis pointing up perpendicular to the paper. It will be observed from the locations of the accelerometers that translational accelerations along the y-axis can be sensed by accelerometer 50 while those along the x-axis can be sensed by either accelerometer 48 or 52. A miscomparison of the outputs of the two x-sensitive accelerometers will indicate a rotation about the z-axis. A clockwise or counterclockwise rotation will be indicated depending upon which x-accelerometer 48 or 52 provides the larger magnitude sensed signal.

Ferromagnetic reaction plates 60, 62, 64, 66 of the same size can be erected symmetrically about the center of the frame's floor near each corner along the diagonals so as to lie in the reaction planes. Four electromagnet cores 70, 72, 74, 76 with coils may be attached to the bottom surface of the suspended cab so that each faces one of the reaction plates. Attractive forces generated by the control system by means of the four electromagnet core-coils are exerted in such a way as to separate or bring closer the core-coils from their associated reaction plates. The positioning of the core-coils with respect to the reaction planes can of course vary. As shown, for example in FIG. 2, electromagnet core-coils situated along the same diagonal at opposite corners, i.e., the pair 70, 76 or the pair 72, 74, are arranged to exert attractive forces on opposite sides of the reaction plane so that a pair of electromagnets associated with one of the reaction planes act in concert to counteract clockwise rotational forces while the other pair counteracts counterclockwise rotational forces. Electromagnetic actuators acting along axes intersecting the same cab wall, e.g., 74, 76 or 70, 72 may be situated in between that wall and their respective reaction plates so they may co-act to offset translational forces.

However, it should be understood that the electromagnets in FIG. 2 could all be situated on opposite sides of the reaction plates than the sides shown with the only change being that all control actions would be reversed. Or, the core-coil pairs for co-acting against a particular direction of rotational disturbing forces can be associated with adjacent corners of the cab such that the are arranged, with respect to the diagonals, on the same side of each reaction plate so that the diagonally associated pairs are no longer co-acting. In that case, the equations would of course have to be rewritten but the same principles as disclosed herein would apply in general. It should also be understood that the reaction plates could be mounted on the underside of the cab with the electromagnet core-coils mounted on the floor of the frame. It should also be understood that an "X" or diagonal concept with "reaction planes" has been introduced as a teaching tool, is merely a conceptual aid for describing a preferred embodiment and need not necessarily be embodied or even conceptually applicable in all applications of the invention. Even if conceptually applicable in whole or in part to other embodiments, it should be understood that the orientation of the "X" need not be from corner to corner as described but could lie in any convenient orientation. Similarly, the actuators and reaction plates need not be located between the bottom of the cab and the floor of the frame. Nor need they all necessarily be at the same level, although such an arrangement could cause unneeded complexity. Needless to say, the invention is not restricted to the use of four actuators, as three, four, five or more could be used. Four has been selected as a convenient number that fits well with the symmetry of a typical elevator car and hoistway.

Figure 3:
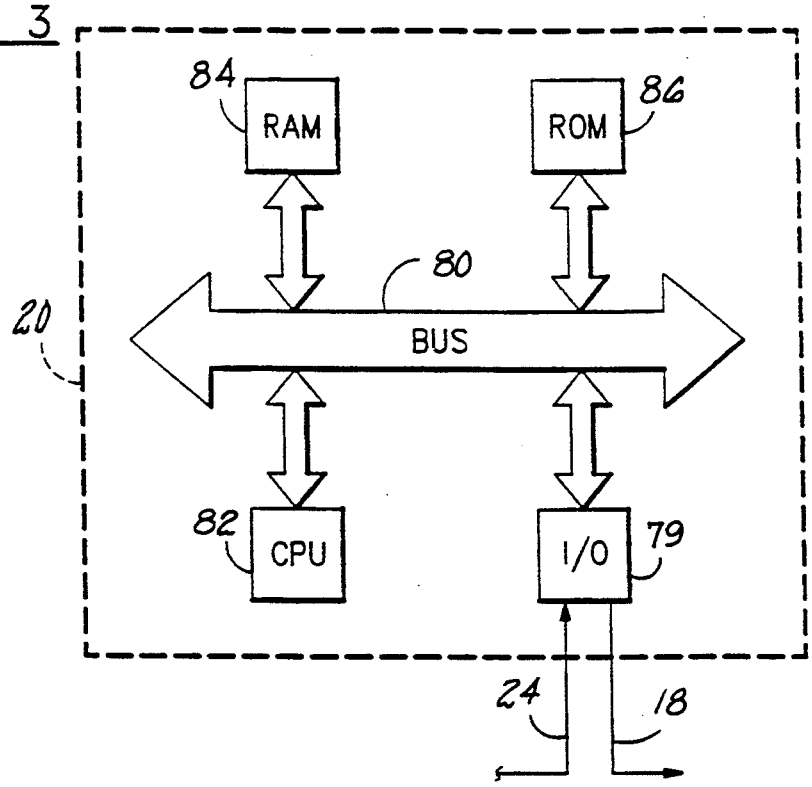
FIG. 3 shows a digital means for carrying out the control of FIG. 1.

Turning now to FIG. 3, the control 20 of FIG. 1A is illustrated in a digital signal processor embodiment which may comprise an Input/Output (I/O) device 79 which may include art analog-to-Digital (A/D) converter (not shown) responsive to an analog signal provided by sensors 22, which may be accelerometers 48, 50, 52 as shown in FIG. 2, and which may further comprise a Digital-to-Analog (D/A) converter (not shown) for providing force command signals on line 18 to an analog actuator 16 which may comprise the actuators 53, 54, 55, 56 of FIG. 2. Also within the control 20 of FIG. 3 is a control, data and address bus 80 interconnecting a Central Processing Unit (CPU) 82, a Random Access Memory (RAM) 84 and a Read Only Memory (ROM) 86. The CPU executes a step-by-step program resident in ROM, storing input signals having magnitudes indicative of the value of the sensed parameter as manifested on the line 24, signals having magnitudes representing the results of intermediate calculations and output signals having magnitudes indicative of the value of the parameter to be controlled as manifested in the output signal on line 18.

Figure 4:
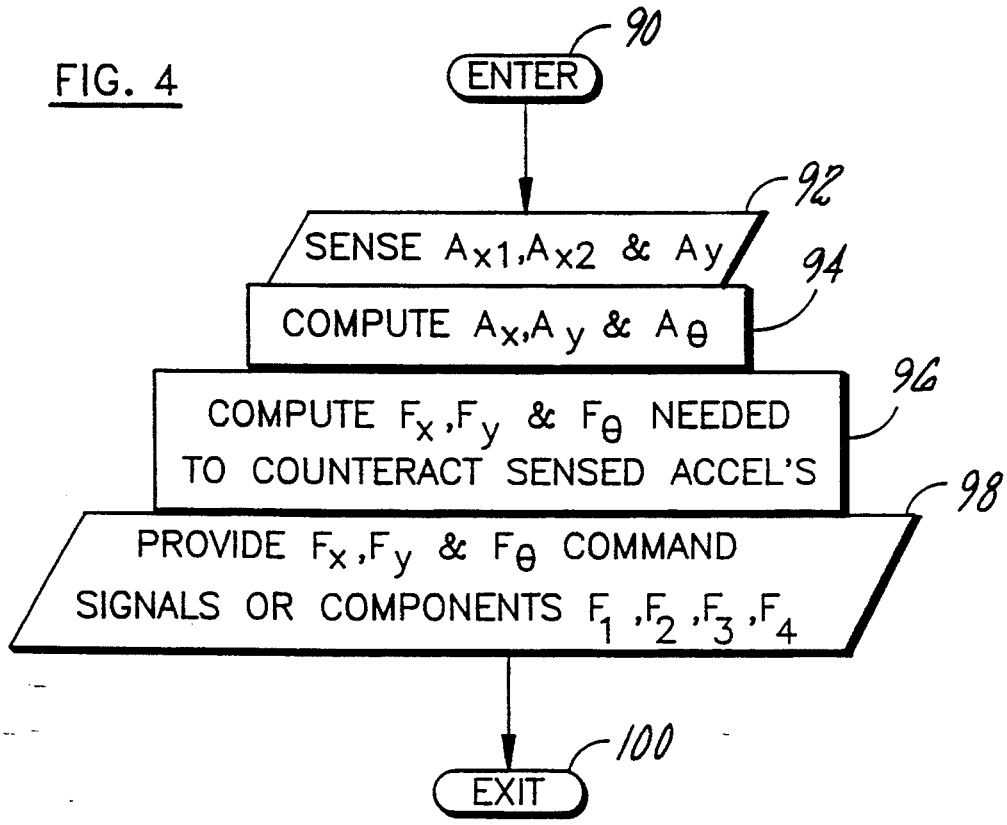
FIG. 4 shows a sequence of steps which may be carried out by a the processor of FIG. 3.

Returning to the arrangement of the embodiment of FIG. 2 and at the same time referring to FIG. 4, a step-by-step program will be explained for execution by the CPU of FIG. 3 in effecting the closed loop control function previously explained in connection with the control 20 of FIG. 1 and the embodiment thereof shown in FIG. 3. After entering at a step 90, an input step 92 is executed in which the magnitudes of the signals on line 24 are acquired by the I/O unit 79. For the purposes of FIG. 2, these shall be referred to as signals $A_{x1}$, $A_{x2}$ and $A_y$ provided, respectively, by accelerometers 48, 52, 50 and stored in the RAM 84 of FIG. 3. One or the other of the two x-axis accelerometers 48, 52 can be used in a step 94 to compute the magnitude of a positive or negative $A_x$ signal, or both can be used as a check against one another, used to provide an average, or used in some such similar redundancy technique. (Of course, it should be realized that the steps 92, 94 can be combined into a single sensing step if a rotation sensor is provided along with two translational [x and y] sensors). From a comparison of the two signals provided by accelerometers 48, 52, a computation of $A_\theta$may be made in step 94. The magnitude of the signal $A_\theta$ will depend on the degree to which the magnitude of the signals from accelerometers 48, 52 differ. The sign of their summation determines the rotational direction. The values of $A_x$, $A_y$ and $A_\theta$ are stored temporarily in RAM 84.

A step 96 is next executed in which a computation is made of the forces needed to counteract the sensed accelerations. This is made based on the known mass of the suspended cab and the formula F=ma where "F" represents the required counterforce, "m" the mass of the suspended cab and "a" the value of the sensed acceleration. Thus, $F_x$, $F_y$ and $F_\theta$ are computed from the signals $A_x$, $A_y$ and $A_\theta$ that were stored in RAM 84 in step 94. These computed values are provided in the form of force command signals on line 18 as indicated in a step 98. It should be understood that the orientation of the actuators as shown in FIG. 2 are such that a command signal calling for a positive x-direction counterforce will have to be exerted by electromagnets 53 and 55 acting in concert, each providing half the required counterforce by each providing a force equal to the commanded x-direction force multiplied by cos(45°). Similar divisions of counterforces are made for the y-direction and for rotations as well. A set of formulae that will cover all the possibilities follows (in the following equations, the subscripts 1, 2, 3, 4 correspond, respectively, to electromagnetic actuators 53, 54, 55, 56 of FIG. 2):

$$F_{x+}:\quad F_1=-(KCS)(F_{x+})$$
$$F_3=(KCS)(F_{x+})$$

-continued $$F_{x-}:\quad F_2=(KCS)(F_{x-})$$
$$F_4=(KCS)(F_{x-})$$

$$F_{y+}:\quad F_1=(KCS)(F_{y+})$$
$$F_2=(KCS)(F_{y+})$$

$$F_{y-}:\quad F_3=(KCS)(F_{y-})$$
$$F_4=(KCS)(F_{y-})$$

$$F_{\Theta+}:\quad F_2=(KCS)(F_{\Theta+})$$
$$F_3=(KCS)(F_{\Theta+})$$

$$F_{\theta-}:\quad F_1=(KCS)(F_{\Theta-})$$
$$F_4=(KCS)(F_{\Theta-})$$

where F=force, and

KCS=cos(45°)=sin(45°)=0.707.

Figure 10:
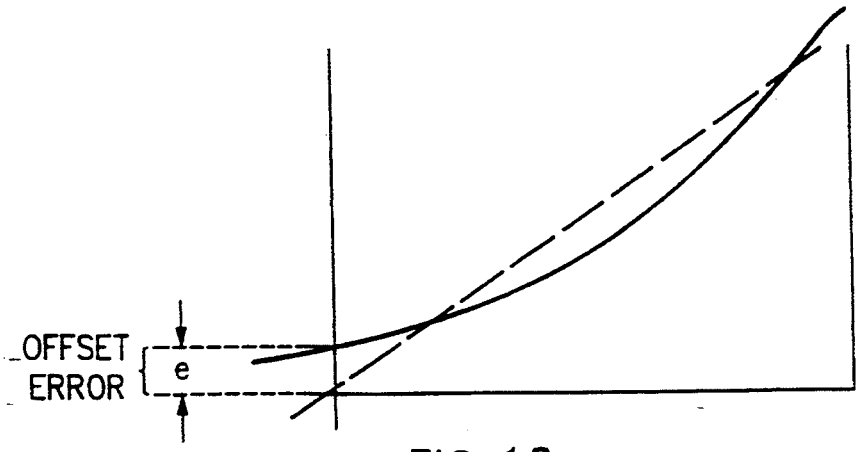
FIG. 10 illustrates the concept of nonlinearity and offset in exaggerated form, according to the present invention.

After making the necessary computations and providing the required counterforce command signals the program may then be exited in a step 100. However, it is preferable to add additional steps in order to superimpose a system for insuring against imperfectly levelled accelerometers and also against a changing offset in the accelerometers. For purposes of embodiments of the present invention, accelerometers have two major errors: (i) offset drift and (ii) pickup of unwanted gravity components due to not being perfectly level; also present, but not as significant, are (iii) linearity errors. A non-level accelerometer will sense accelerations due to gravity in proportion to the sine of the angle it makes with the vertical. Referring to FIG. 10, a level accelerometer's output is there shown in exaggerated form, for teaching purposes, to show both offset and nonlinearity. Correction for nonlinearity is not usually important in embodiments of this invention but may be corrected for, if desired. Assuming the nonlinearity retains its basic relationship with true linearity as adjusted for changes in offset, such nonlinearity may be corrected at each stage of sensed acceleration by consulting a lookup table which is used to supply a corrective factor. If offset were constant over time it could be corrected for straightforwardly with a constant correction factor. But, since offset can change over time due to temperature, aging, etc., corrections should be made in a dynamic manner. Offset and changing offset, as well as accelerations due to gravity, can be corrected by providing a relatively slower acting feedback control system for controlling the position of the cab with respect to the hoistway centerline. This may be done by recognizing that the average lateral acceleration must be zero (or the cab would travelling off into space). The slow acting loop offsets the average accelerometer output signal. Averaging may be accomplished, e.g., using an analog low-pass filter or a digital filter.

Figure 5:
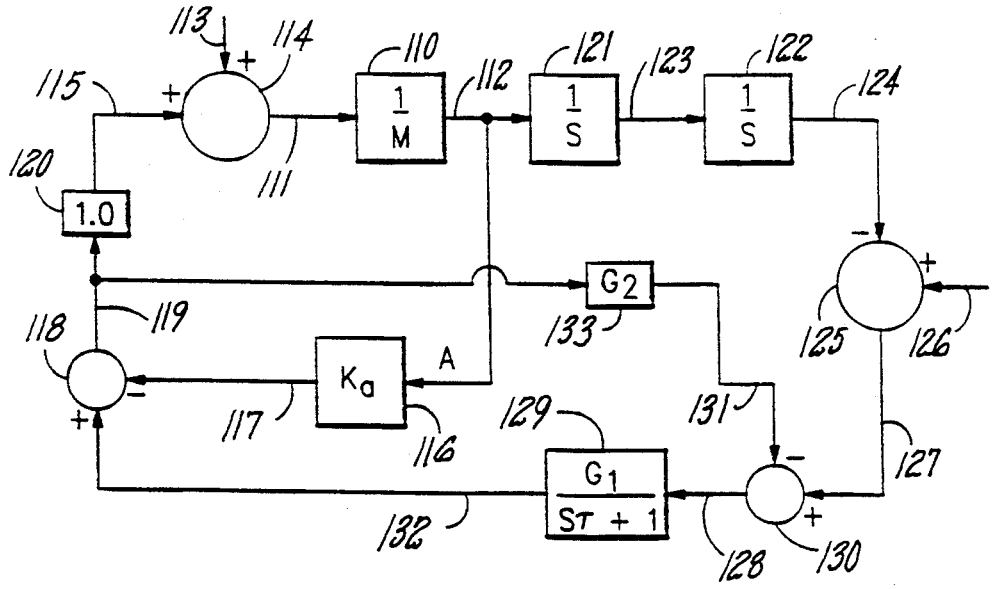
FIG. 5 shows a mathematical abstract of a preferred control scheme for carrying out the active control of FIG. 1 having an inner loop with acceleration feedback and slower outer loops with position and acceleration feedback.

Thus, if we think of a single axis of control such as the x-axis shown in FIG. 2, the theory of operation of such a system for controlling the cab with both acceleration and position sensors is shown in FIG. 5. The system in elementary form comprises the cab mass as illustrated by a block 110. The cab mass is acted upon by a force on a line 111 which causes an acceleration as illustrated by a line 112. A disturbing force is shown schematically as a signal on a line 113 summed in a "summer" 114 (an abstract way of representing that the disturbing force is physically opposed by the counteracting force) with a counterforce signal on a line 115 provided in proportion ($K_a$) to the acceleration (A) shown on the line 112 as sensed by an accelerometer 116 which provides a sensed acceleration signal on a line 117 to a summer 118. The scale factor ($K_a$) of the accelerometer is (volt/m$^w$/s). (As previously indicated, the acceleration on line 112 is produced by the disturbing force on line 113 interacting with the mass of the suspended cab according to the relation F/M as suggested in block 116, where F is the disturbing force and M is the mass of the cab. The summer 114 represents the summation of the disturbing force on line 113 and the counterforce on line 115 to provide a net force on a line 111 acting on the mass 110.) The summer 118 provides a signal on a line 119 to a force generator 120 having a transfer characteristic of 1.0 Newton/volt. The summer 118 serves to collect an inner acceleration loop signal on line 117 with the outer acceleration and position loop signals to be described below prior to introduction on the line 119 into the force generator 120. The inner acceleration loop comprising elements 110, 116, 120 and the associated summers forms the primary control loop used for mass augmentation.

The description of FIG. 5 so far covers the theory of the control system previously described in connection with FIGS. 1–4. Secondary control loops may also be added as illustrated in the abstract in FIG. 5.

Shown are two secondary control loops which may be used for nulling offsets in the accelerometer 116 caused, e.g., by misalignment with gravity and due to manufacturing imperfections. The first of these secondary loops corrects on the basis of position offsets. A position transducer that gives car position is represented abstractly by an integrator block 121 and an integrator block 122. The integrator 121 provides a velocity signal on a line 123 to the integrator 122 which in turn provides a position signal on a line 124. The cab position signal on line 124 is compared in a summer 125 with a reference signal on a line 126. The signal on the line 126 would ordinarily be a fixed DC level scaled to represent, e.g., the x-position (in the cab coordinate system 57 of FIG. 2) of a selected referent such as the hoistway centerline (which will be substantially coincident with true vertical, i.e., a line along which the earth's gravity will act). This entire process is carried out in practice by use of a position sensor that gives the relative position between the cab and car frame. The summer 125 provides a signal on a line 127 which represents the relative position of the cab with respect to the frame and may be characterized as the relative position signal or the position error signal. It is provided on a line 128 to a low-pass filter 129 after being summed in a summer 130 with a signal on a line 131. The low-pass filter 129 provides a filtered signal on a line 132 which causes the force on the line 115 to be applied on the line 111 to the cab 110 until the position error signal is driven to zero or close to zero..

A second secondary control loop may be introduced if a position signal is not conveniently available or to enhance the stability of the position correction control loop. The position error signal on line 127 may thus be modified in the summer 130 by being summed with the signal on line 131 which is provided by a gain block 133 which is in turn responsive to the signal on line 119 which is representative of the acceleration sensed in the primary loop.

An extraneous signal on line 119 will appear directly on line 111 if $G_1=0$ and $G_2=0$. Assuming no indicated position error on line 127 and nonzero gains $G_1$ and $G_2$, a disturbance manifested by an acceleration signal on line 117 will appear on line 111 reduced by a dynamic factor $$\frac{s\tau + 1}{s\tau + (1 + G_1 \cdot G_2)}.$$

This factor approaches unity at higher frequencies, indicating no effectiveness. At lower frequencies, however, this factor approaches $[1/(1+G_1,G_2)]$. Typically, $G_1{*}G_2$ could be chosen equal to nine (9) to reduce accelerometer offsets by a factor of ten (10).

The position feedback loop offers the advantage of very low error. Without the accelerometer feedback loop 133, 130, 129, 118 and/or practical control elements being present this loop is unstable. Assuming gain $G_2=0$, the only way for the position loop to be stable is for the cab mass to be acted upon by damping, friction and an inherent spring rate due to pendulousity, acting singly or in concert. One or more of these elements will be present in a practical system. Use of an accelerometer loop by making $G_2$ nonzero can enhance the operation of the position loop.

Figure 6:
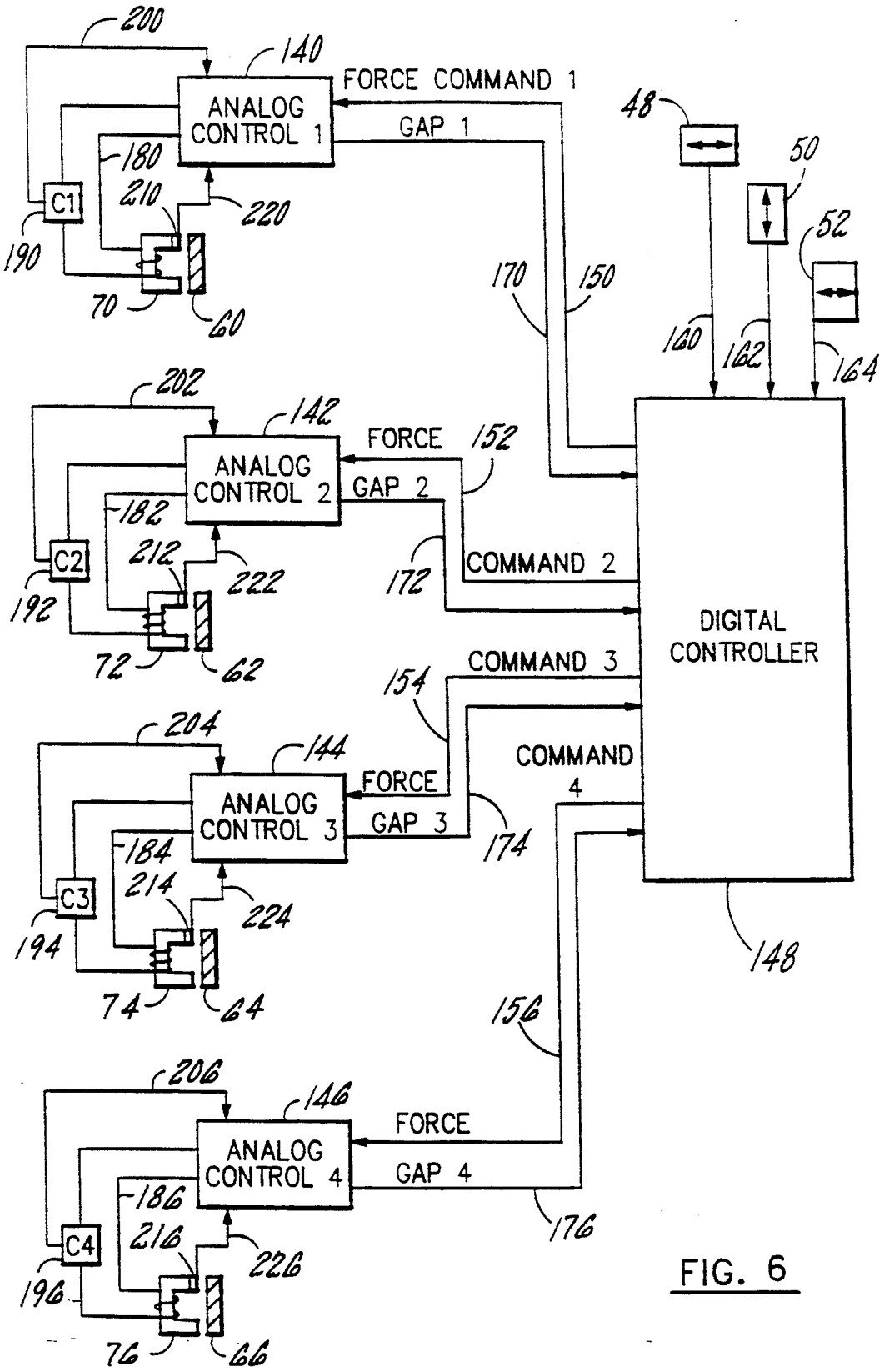
FIG. 6 shows concrete means for carrying out the abstracted control of FIG. 5 in which a fast, analog control is used in the inner loop and a relatively slow but more accurate, digital control is used in the outer loop.

The control represented in abstracted form in FIG. 5 may be carried out in numerous different ways but a preferred approach is shown in FIG. 6.

There, a fast-acting analog loop for quickly counteracting disturbing forces is combined with a slower acting but more accurate digital loop for compensating for gravity components and drifts in the accelerometers. A plurality of such fast-acting analog loops may be embodied in analog controls 140, 142, 144, 146 as shown, one for each of the actuators 53, 54, 55, 56, respectively, of FIG. 2. With proper interfacing (not shown), a single digital controller 148 can handle the signals to be described to and from all four analog controls. Each analog control responds to a force command signal on lines 150, 152, 154, 156 from the digital controller 148. The force command signals will have different magnitudes depending on the translational and rotational forces to be counteracted. The digital controller 148 is in turn responsive to acceleration signals on lines 160, 162, 164 from the accelerometers 48, 50, 52, respectively, and to position signals on lines 170, 172, 174, 176 indicative of the size of the airgaps between the coil-cores 70, 72, 74, 76 and their respective plates 60, 62, 64, 66.

In response to the force command signals on lines 150, 152, 154, 156, the analog controls 140, 142, 144, 146 provide actuation signals on lines 180, 182, 184, 186 to the coils of the coil-cores 70, 72, 74, 76 for causing more or less attractive forces between the respective cores 70, 72, 74, 76 and their associated reaction plates. The return current through the coils is monitored by current monitoring devices 190, 192, 194, 196 which provide current signals on lines 200, 202, 204, 206 to the respective analog controls 140, 142, 144, 146. The current sensors may be, e.g., Bell IHA-150.

A plurality of sensors 210, 212, 214, 216, which may be Hall cells (e.g., of the type Bell GH-600), are respectively associated with each core 70, 72, 74, 76, for the purpose of providing an indication of the flux density or magnetic induction (volt-sec/m$^2$) in the gap, i.e., between the faces of the cores and the associated plates or, otherwise stated, the flux density in the airgaps therebetween. The sensors 210, 212, 214, 216 provide sensed signals on lines 220, 222, 224, 226, respectively, to the analog controls 140, 142, 144, 146.

Figure 7:
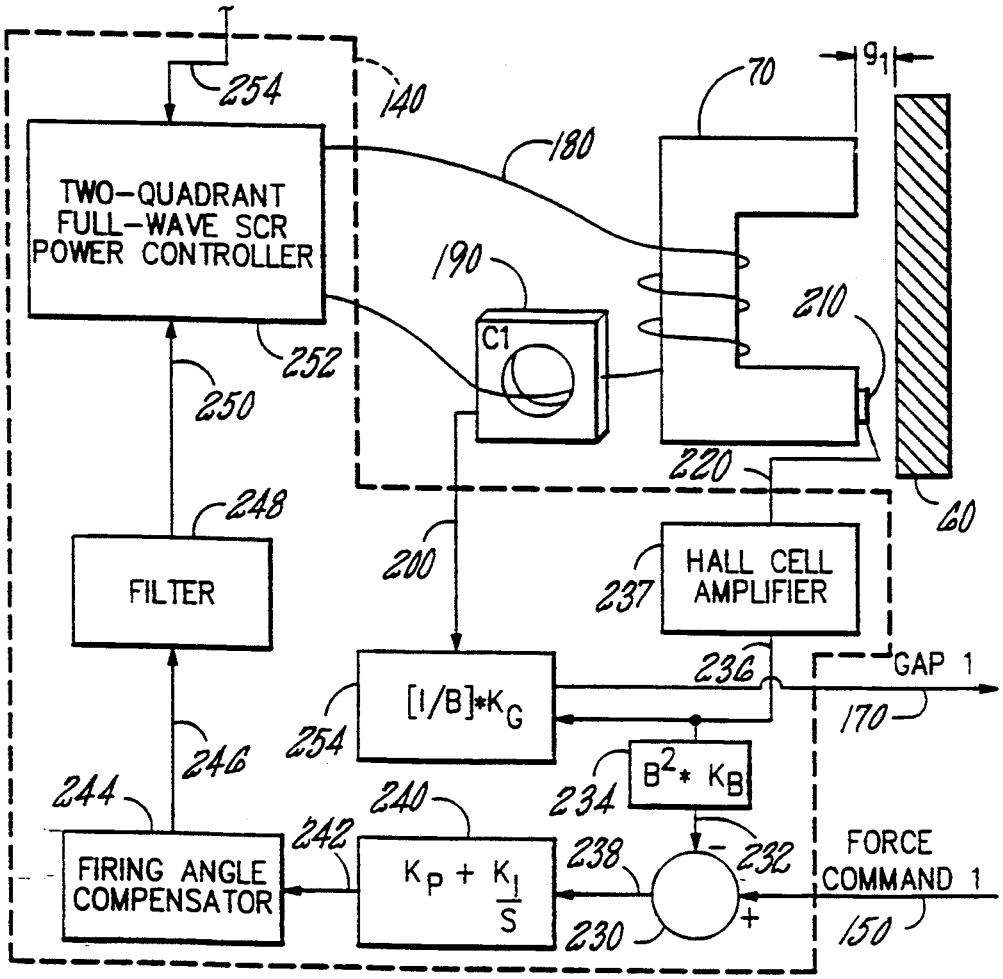
FIG. 7 shows the analog control of FIG. 6 in more detail.

Referring now to FIG. 7, the analog control 140 among the plurality of analog controls 140, 142, 144, 146 of FIG. 6, is shown in greater detail. The other analog controls 142, 144, 146 may be the same or similar. The force command signal on line 150 from the digital controller 148 of FIG. 6 is provided to a summer 230 where it is summed with a signal on a line 232 from a multiplier 234 configured as a squaring circuit (to linearize control) having a gain selected dimensionally-to be equivalent to magnetization (amp/meter) and properly scaled to convert a signal on a line 236 indicative of flux density to one indicative of force. The flux density signal on line 236 is provided by a Hall cell amplifier 237 which is used to boost the level of the signal on the line 220 from the Hall cell 210.

Figure 8:
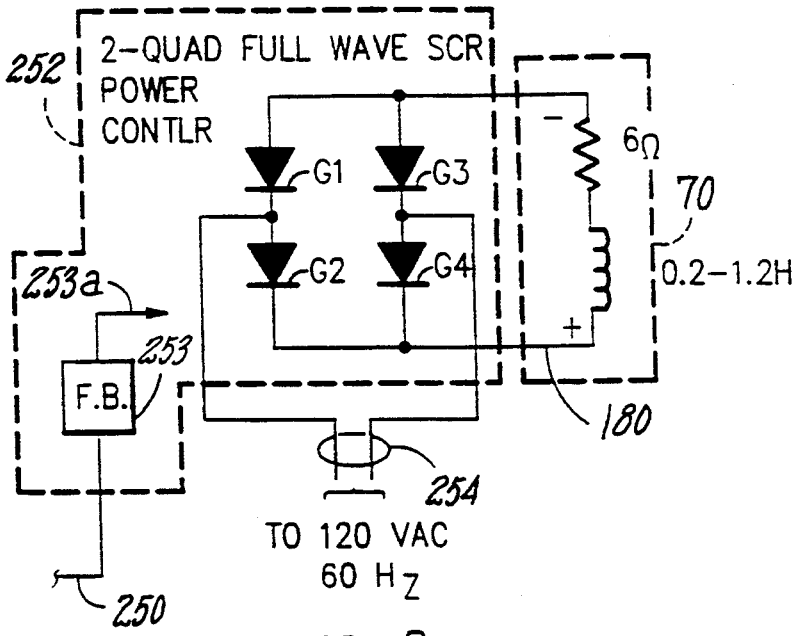
FIG. 8 is an illustration of a power controller according to the present invention.

The summer 230 provides a force error signal on a line 238 to a proportional-integral (P-I) amplifier 240 which provides a P-I amplified signal on a line 242 to a firing angle compensator 244. Compensator 244 provides a firing angle signal on a line 246 which controls the firing angle of a plurality of SCRs in a controller 252 after being filtered by a filter 248 which in turn provides a filtered firing angle signal on a line 250 to the controller 252 which is more fully described as a single phase, two-quadrant, full-wave, SCR power converter. This type of converter is preferred over one-quadrant and half-wave converters. The least preferred combination would be a one-quadrant, half-wave. There would be a slight cost savings in using these non-preferred approaches but the dynamic performance would be significantly degraded. A cheap, one-quadrant system is possible using a DC rectifier and a transistor PWM chopper. The highest performance approach would be a full-wave, two-quadrant, three phase converter but this is not the preferred approach because of cost considerations. The two-quadrant, full wave converter 252 of FIG. 7 may be made up, for example, of a pair of Powerex CD4A1240 dual SCRs having a circuit configuration as shown in part FIG. 8 (not shown are RC snubbers across the SCRs) and a commercial firing board 253 such as a Phasetronics PTR1209 which is shown in FIG. 9. Gate signals on a plurality of lines 253*a* for the SCRs are provided by the firing board 253. The power controller 252 is powered with 120 VAC on a line 254 as is the firing board and provides the proper level of current on line 180 in response to the filtered firing angle signal on line 250.

The signal on the line 200 from the current sensor 190 is provided to an analog multiplier/divider 254 (such as an Analog Devices AD534) which is also responsive to the flux density signal on line 236 for dividing the magnitude of the current signal on line 200 by the magnitude of the flux density signal on line 236 and multiplying the result by a proportionality factor in order to provide the signal on line 170 (back to the digital controller 148 of FIG. 6) indicative of the magnitude of a gap ($g_1$) between the face of the core of the core-coil 70 and the plate 60.

As mentioned previously, the digital controller 148 is responsive to the gap signals on the lines 170, 172, 174, 176, as well as the acceleration signals on lines 160, 162, 164, for carrying out, in conjunction with the analog control of FIG. 7, the control functions of FIG. 5. Instead of generating force signals on the lines 150, 152, 154, 156 in exactly the same manner as previously disclosed in connection with FIGS. 3 and 4, such signals, though generated in a similar manner, are modified by summation with corrective force signals calculated to correct for position imbalances detected by the position sensor 210 and similar sensors 270, 272, 274 associated respectively with the actuators 54, 55, 56 as shown in FIG. 2. (Note: These are the Hall sensors used to find flux density. The signals from position sensor 210 and from current sensor C1, when processed by the divider circuit 254 give the GAP1 signal on line 170. Similar processing in the other channels yields the GAP2, GAP3 and GAP4 signals on lines 172, 174, 176.) Such corrective force signals may be generated, for example, by first resolving the sensed position signals into components along the axes of the Cartesian coordinate system 57 of FIG. 2 as in the equations which follow, $$P_{x+} = (P_1 + P_3)/(2KCS),\ P_{x-} = (P_2 + P_4)/(2KCS),$$

$$P_{y+} = (P_1 + P_2)/(2KCS),\ P_{y-} = (P_3 + P_4)/(2KCS),$$

$$P_{\Theta+} = (P_2 + P_3)/2,\ P_{\Theta-} = (P_1 + P_4)/2,$$

and then, based on the above, computing or selecting $P_x$, $P_y$, and $P_\theta$ (which together specify the absolute position of the cab), from $P_{x-}$ and $P_{x+}$, $P_{y-}$ and $P_{y+}$, and $P_{\theta+}$ and $P_{\theta-}$. $P_x$, for example, may be computed as follows:

$$P_x=(P_{x+}-P_{x-})/2.$$

Or, one can select $P_{x+}$ or $P_{x-}$, depending on which quantity is smaller. (Note: For large gaps, i.e., for large $P_{x+}$ or $P_{x-}$, the value is likely to be very inaccurate and should be discarded). The resultant components are used to determine position-control force components $F_{px}$, $F_{py}$, $F_{p\theta}$ as illustrated in FIG. 5 on a single-axis basis ("p" stands for position feedback). $P_x$, for example on line 122, is compared to a reference on line 126 to generate an x-position error signal on line 128. This in turn is passed through a low-pass such as filter 130. This provides an $F_{px}$ signal. For purposes of resolving the required x-counterforce, if a positive force is required $F_{p1}=F_{p3}=(0.5)(F_{px})/(\cos 45°)$. For a negative force, $F_{p2}=F_{p4}=(0.5)(F_{px})/(\cos 45°)$. This same procedure may be followed for $F_{py}$ and $F_{p\theta}$ using, of course, the appropriate equations. Thus the force components $F_{px}$, $F_{py}$ and $F_{p\theta}$ may be resolved into corrective signals $F_{p1}$, $F_{p2}$, $F_{p3}$, $F_{p4}$, according to the following complete set of equations, $$F_{px+}:\ F_1 = (KCS)(F_{px+})$$
$$F_3 = (KCS)(F_{px+})$$

$$F_{px-}:\ F_2 = (KCS)(F_{px-})$$
$$F_4 = (KCS)(F_{px-})$$

$$F_{py+}:\ F_1 = (KCS)(F_{py+})$$
$$F_2 = (KCS)(F_{py+})$$

$$F_{py-}:\ F_3 = (KCS)(F_{py-})$$
$$F_4 = (KCS)(F_{py-})$$

$$F_{p\Theta+}:\ F_2 = (KCS)(F_{p\Theta+})$$
$$F_3 = (KCS)(F_{p\Theta+})$$

-continued $$F_{p\Theta-}: \; F_1 = (KCS)(F_{p\Theta-})$$
$$F_4 = (KCS)(F_{p\Theta-})$$

where F=force, and

KCS=cos(45°)=sin(45°)=0,707, which are then summed with the acceleration feedback signals $F_1$, $F_2$, $F_3$, $F_4$ (such as the signal on line 112) generated in the manner previously described in connection with FIGS. 1–7.

It should be realized that a valid position reading will only be available from the flux sensors 210, 212, 214, 216 of the type described unless its associated force actuator 70, 72, 74, 76, respectively, is being driven. This means that any processing algorithm must be dependent upon whether or not there are magnet actuation currents present.

An additional teaching of my invention is that the electromagnets may be used to control the position of the cab at stops, e.g., to bring the suspended cab to rest with respect to the frame while on- and off-loading passengers. Of course, the signal processor of FIG. 3 may handle additional control functions such as the starting and stopping of cars and the dispatching of cars. In the case of stopping at a floor, it will receive a signal on line 24 or a similar signal line indicating the car is at rest and will then provide a signal on line 18 to control the position of the suspended cab. For, example, if the car 38 of FIG. 2 is oriented in the hoistway such that the left hand vertical edge of the car represents the cab's sill in alignment with a hoistway door sill 280, then the signal processor of FIG. 3 may provide force command signals to actuators 53, 55 in order to provide the attractive forces needed to force the suspended cab up against, e.g., stops 282, 284 mounted in the frame 14 so as to push the cab sill into position at rest with respect to, and in close alignment with, the hoistway entrance sill after the frame comes to rest.

Figure 9A:
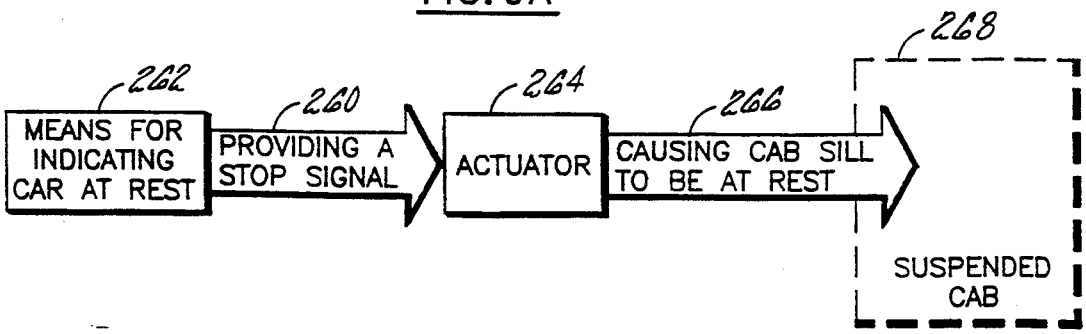
FIG. 9A shows a method of causing a suspended cab to be at rest with its sill adjacent to a hall sill, according to the present invention.
Figure 9:
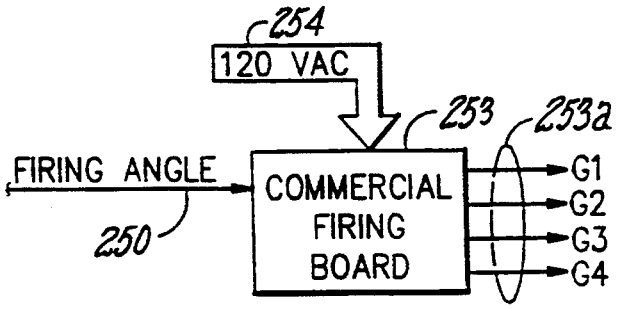
FIG. 9 illustrates a firing board for gating SCRs in the power controller of FIG. 8, according to the present invention.

The method used to accomplish the same is shown in FIG. 9A where a stop signal is provided in a step 260 from means for indicating the car frame has come to rest and, in response thereto, an actuator 264 provides an actuating signal as shown in a step 266 for causing a suspended cab 268 to come to rest with respect to the car frame such that the cab sill is adjacent to the hall sill and motionless with respect thereto.

Figure 11:
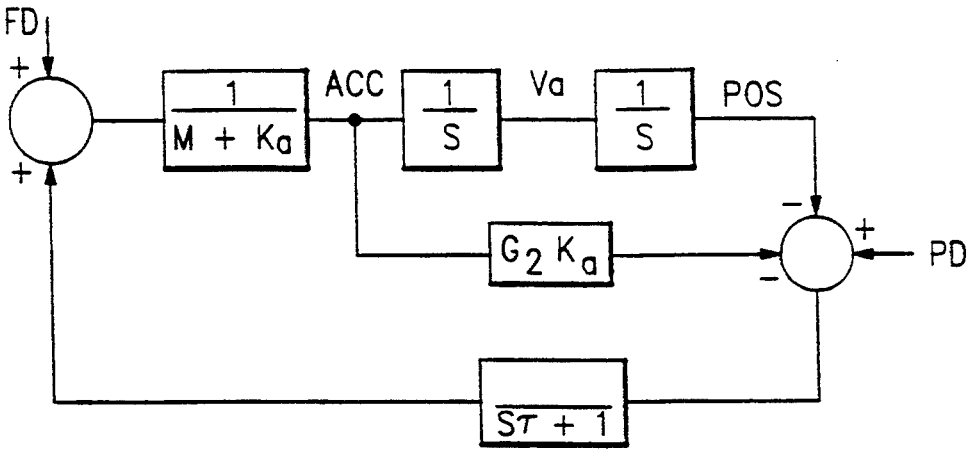
FIG. 11 shows the theory of operation of FIG. 5 in a reduced block diagram form, according to the present invention.
Figure 12:
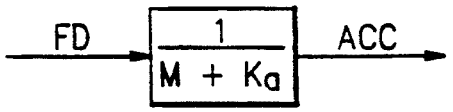
FIG. 12 shows an even more reduced model valid at all but the lowest frequencies, according to the present invention.

I have, in the foregoing description of a best mode embodiment of a three-axis active control for a suspended cab, paid considerable attention to the details of that particular embodiment and taught how to carry it out. But it will be recalled that I have previously indicated that there are any number of different approaches for carrying out the subject matter of my invention which is active control of a suspended cab. The fundamental principle of active control can be carried out in a plurality of coordinated single axis controls as previously described. Recall that FIG. 5 illustrated the theory of operation of single-axis stabilization of horizontal motion of a cab suspended in an elevator frame. In connection therewith, it has been suggested that an accelerometer may be used in a feedback loop to in effect increase the cab mass by electromechanical means. Slow-position and accelerometer regulating loops may be used to compensate for accelerometer offsets, etc. FIG. 11 shows a reduced block diagram of the same concept and FIG. 12 shows an even further reduced model valid at all but the lowest frequencies.

The FIG. 12 diagram may be expressed in units scaled to as follows:

Acceleration of cab=[FD/G][1/(M+Ka)]

where FD is the disturbing force,

M is the mass of the suspended cab,

Ka is the counter-mass "added" by the actuator, and

FD/G is the mass equivalent of the disturbing force using the acceleration due to gravity (G) at the earth's surface.

If, in the foregoing equation, we let Ka=0, i.e., we assume the absence of active control, and let M=1000kg and FD/G=25kg, then we obtain an acceleration due to the disturbing force (FD) of 25/1000=25mG. If we now wish to introduce active control, we can assume Ka=9000kg and we now obtain a tenfold reduction in acceleration due to the disturbance, i.e., 25/(1000+9000)=2.5mG. We can thus conclude that if we proceed along these lines we will at least have an order of magnitude improvement in ride comfort.

Now, assuming a Ka of 9000kg is desired, we can assign an acceleration scale factor (ASF) of 100 Volt/G and a force generator scale factor (FGSF) of Ka/ASF which is equal to 9000kg/100Volt/G=90kg (force)/-Volt or 882 Newton/Volt.

Figure 16:
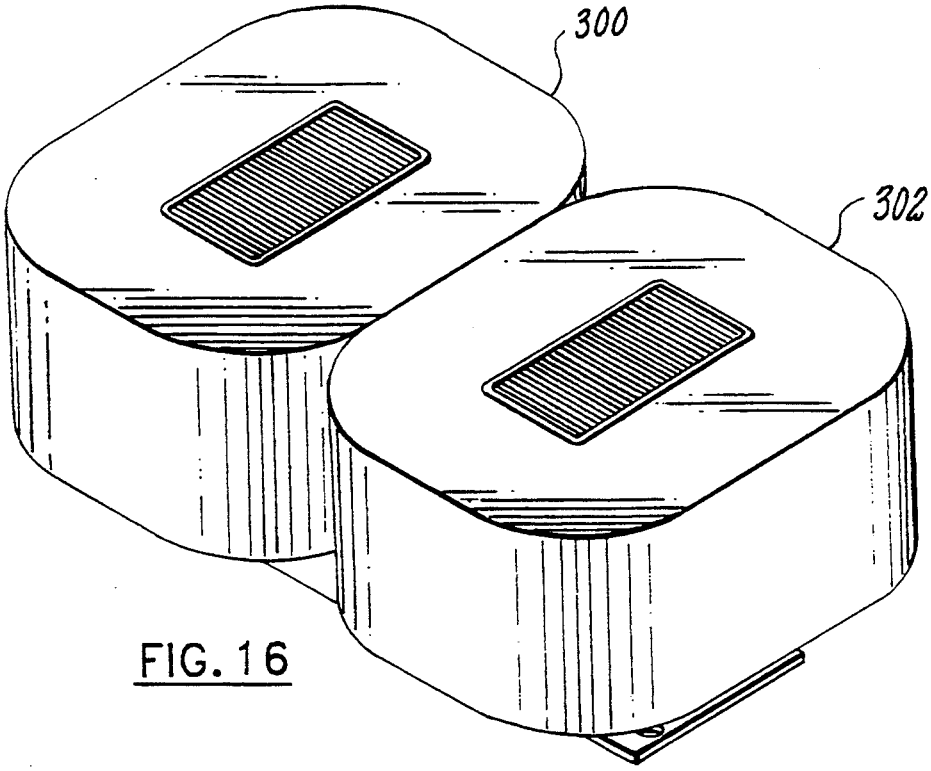
FIG. 16 shows a pair of coils for use with the core of 17, according to the present invention.
Figure 17:
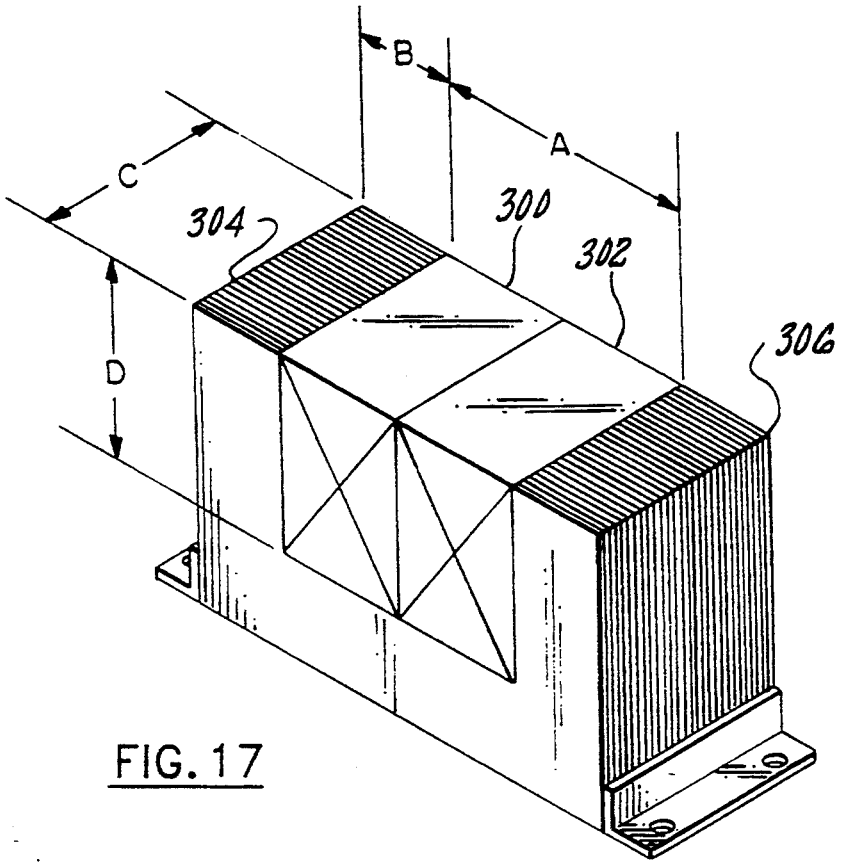
FIG. 17 shows a laminated core for use with the coils of FIG. 16, according to the present invention.

An electromagnet actuator such as described previously may be constructed in a U-shape as shown in FIGS. 16 & 17. In FIG. 16 double coils 300, 302 are shown which fit over legs 304, 306, respectively, as shown in FIG. 17. The coils 300, 302 constitute a continuous winding and are shown in isometric section in FIG. 17. Coil 300 and coil 302 may each, for example be wound with 936 turns of #11 AWG magnet wire at a 0.500 packing factor. The U-shaped core may, for example, be of interleaved construction, 29 GA M6 laminations made of 3.81cm strip stock, vacuum impregnated. The dimensions shown in FIG. 17 may be, for example, A=10.16cm, B=3.81cm, C=7.62cm and D=7.62cm. In that case, the resistance would be 6.7 ohms and the inductance 213mH. Such weighs 22.2kg and is capable of exerting 578 Newtons.

If we use such an electromagnet actuator in a control system such as described previously we can expect an average delay in responding to a command of, say, 4.2 msec. The time delay to develop a full force, say, of 578 Newton at a maximum gap of 20 mm can be estimated at 15 msec as follows (based on the relation v=Ldi/dt):

$$\Delta t = L\Delta i/v = (0.3)(8.6)/(170) = 15 \text{ msec.}$$

The time to develop full force (578 Newton) at minimum gap (5 ram) would be:

$$\Delta t = L\Delta i/v = (1.2)(2.15)/(170) = 15 \text{ msec.}$$

as well.

Figure 13:
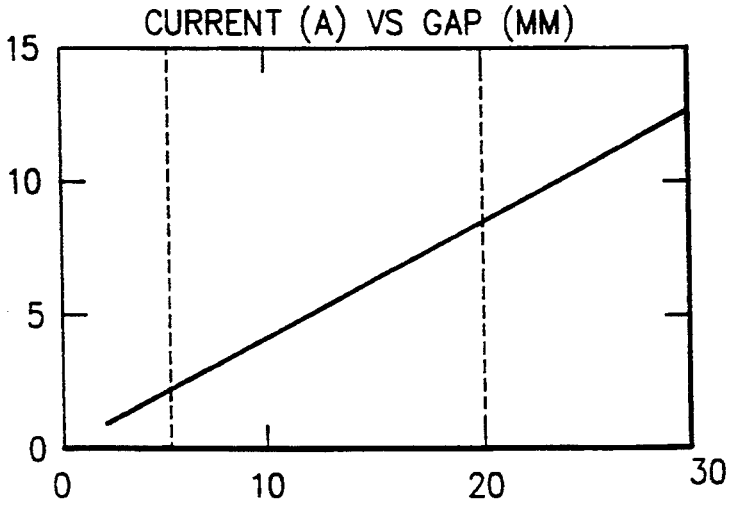
FIG. 13 shows a graph of current vs. airgap, according to the present invention.
Figure 14:
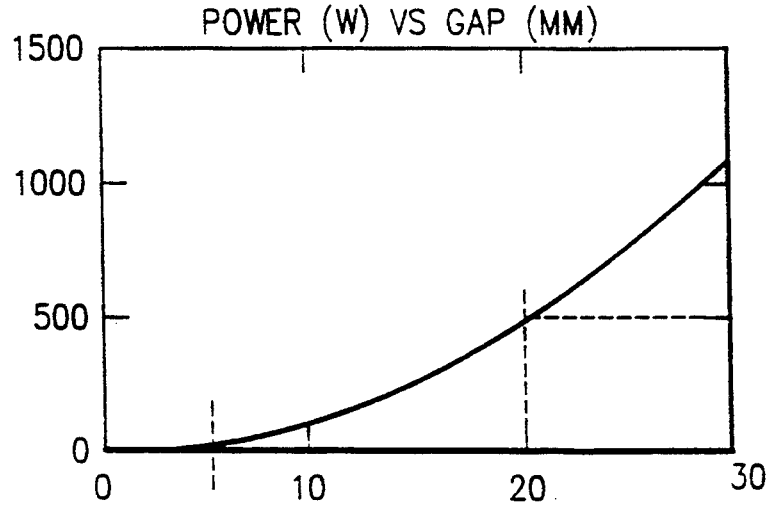
FIG. 14 shows a graph of power vs. airgap, according to the present invention.
Figure 15:
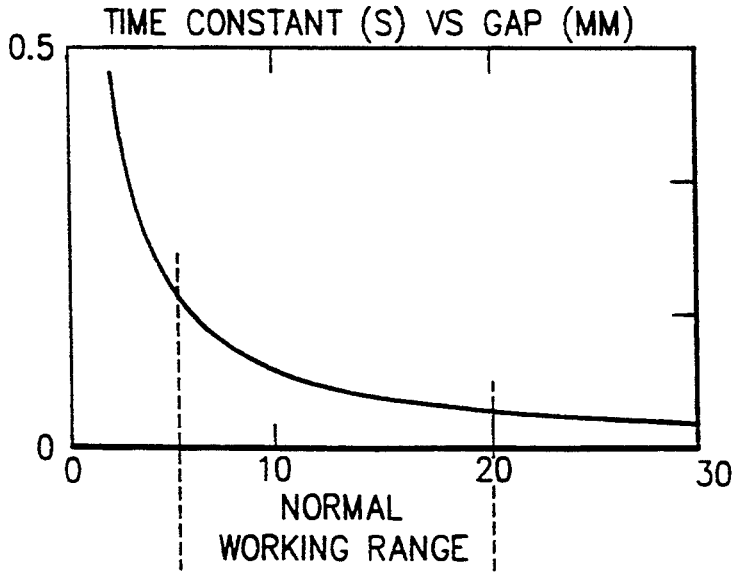
FIG. 15 shows a graph of time constant vs. airgap, according to the present invention.

The time to develop half force would of course be half the time. An accuracy in the gap signal of 10% of full scale can be tolerated. We can present the relation between the gap and several other factors in graphical form as shown in FIGS. 13, 14 & 15. The maximum power is 500 Watts at a maximum allowed 20 mm gap. The average power can be expected to be approximately 125 Watts.

As for short term thermal considerations, the mass of the copper in such an electromagnet is 14.86 kg, having a specific heat of 0.092 cal/g-° C. (=385J/kg° C). The change in temperature for a sixty second application of energy at a rate of 500 Watts will thus be:

$$\Delta^T = \text{Watt-sec}/(385)(14.86)$$
$$= (500)(60)/(385)(14.86)$$
$$\Delta^T = 5.24^\circ \text{ C.}$$

Thus, there is little temperature rise even for maximum power input for one minute.

Figure 18:
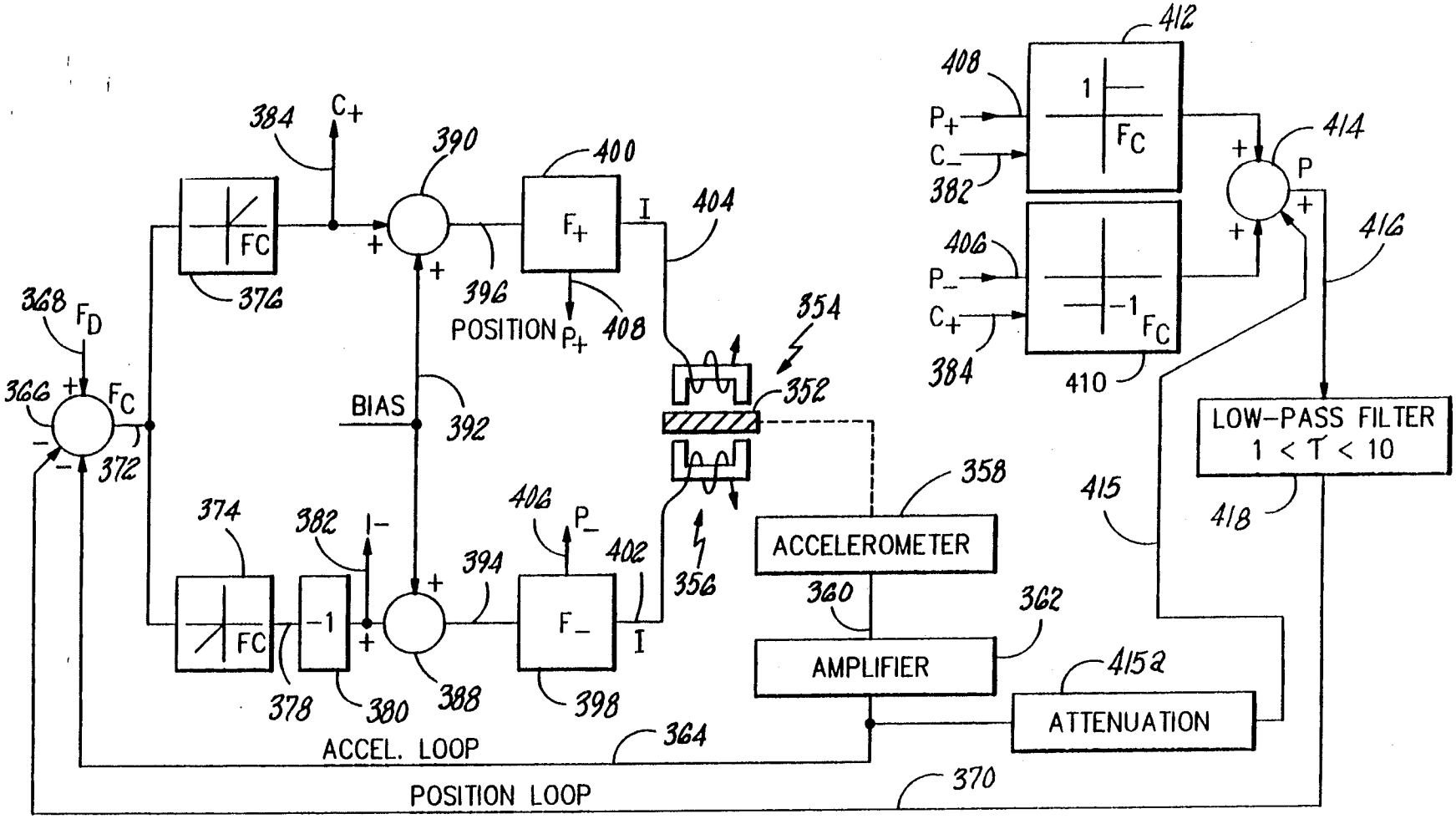
FIG. 18 is an illustration of a single-axis lateral vibration stabilization system, according to the present invention.
Figure 20:
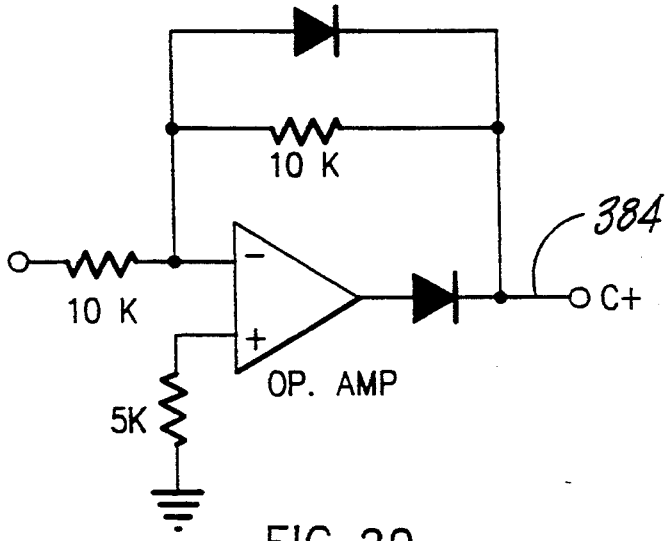
FIG. 20 illustrates a negative rectifier and inverter such as employed in the system of FIG. 18, according to the present invention.
Figure 21:
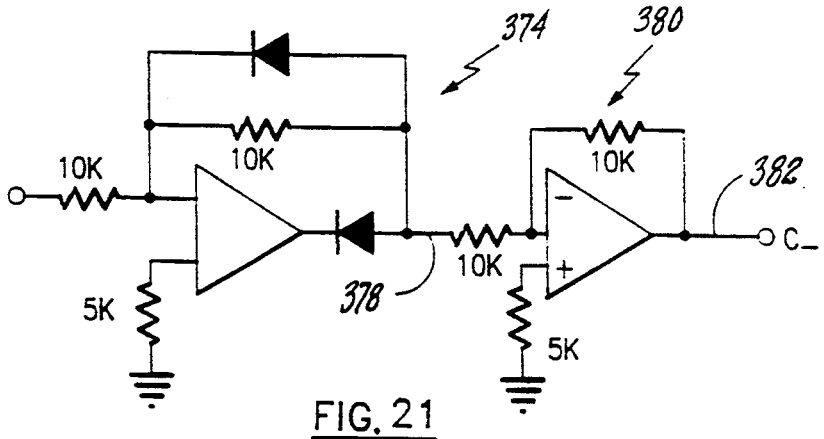
FIG. 21 illustrates a positive rectifier-inverter such as employed in the system of FIG. 18.

FIG. 18 shows a single-axis lateral vibration stabilization system. The concept is the same as shown in FIGS. 5, 11 and 12. The implementation to be described will be analog but it will be understood that it can be carried out digitally as well. In this case, a plate 352 is attached, without limitation, to the suspended cab while a pair of electromagnetic actuators 354, 356 are attached to the elevator car frame. The accelerometer 358 senses accelerations of the suspended cab and provides a sensed signal on a line 360 to an amplifier 362 which in turn. provides an amplified sensed acceleration signal on a line 364 to a summing junction 366 where it is "summed" with a disturbing force signal on a line 368 and a position loop corrective or "error" signal on a line 370. A resultant summed signal on a line 372 is provided to a pair of rectifiers 374, 376 which are shown respectively in FIGS. 20 and 21. The rectifier 374 provide a signal on a line 378 to a signal inverter 380 which is also shown in FIG. 21 and which provide a signal on a line 382 which may be characterized as a negative control signal. Similarly, the rectifier 376 provides a signal on a line 384 which may be characterized as a positive control signal. Both the signals on lines 382 and 384 are summed in respective summing Junctions 388, 390 with a bias signal on a line 392. These provide biased control signals on lines 394, 396 to electromagnetic actuator controllers 398, 400, respectively. The controllers 398, 400 are similar to those shown in FIG. 7.

Figure 19:
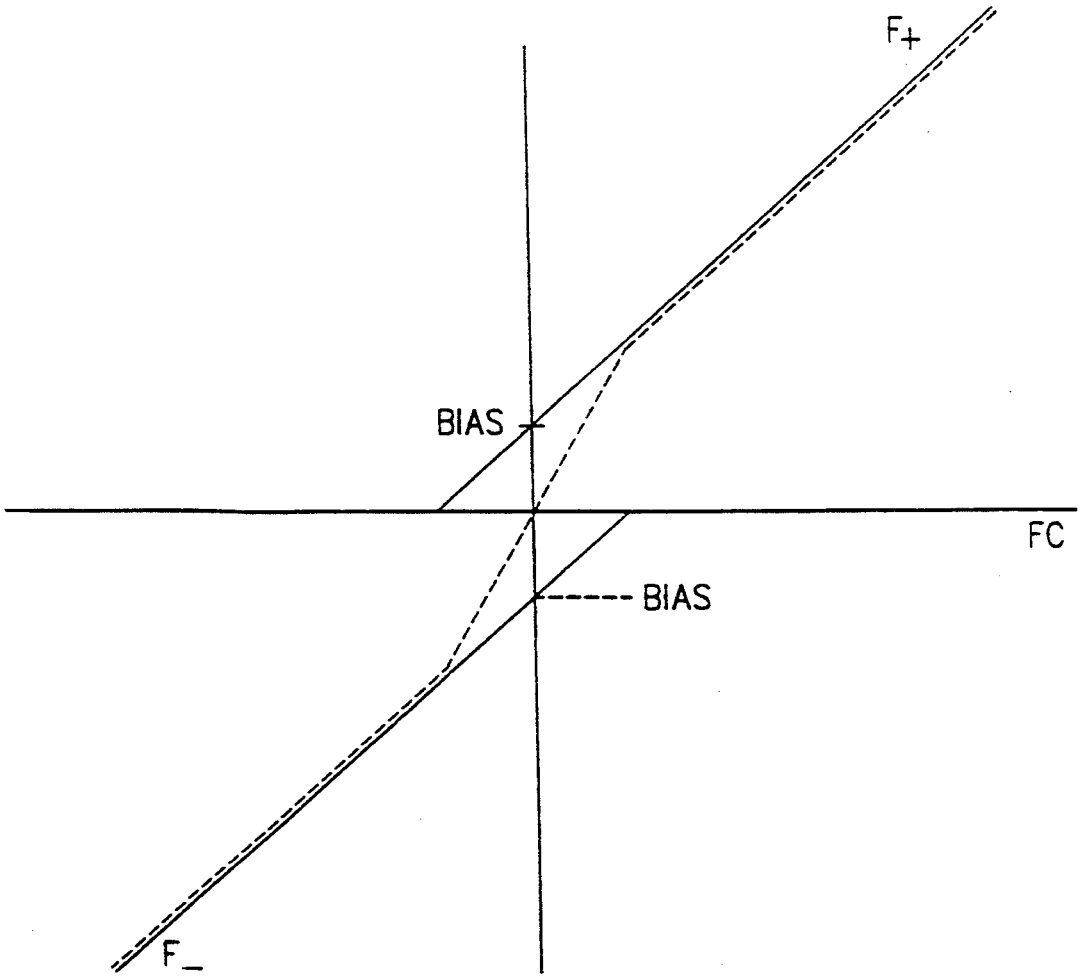
FIG. 19 illustrates the force summation technique employed in the system of FIG. 18, according to the present invention.

The effect of the bias signal on line 392 is illustrated in FIG. 19 which shows the composite resultant force (in dashed lines) of the two forces on either side of the reaction plate 352 (in solid lines) vs. the control signal (FC) for the system of FIG. 18.

This technique is used to prevent discontinuities in control about the zero position point. Without bias, turn-off of one magnet and turn-on of the other could occur at the same time. The illustrated technique, using bias, results in reduced control gain at or near zero force. The advantage is that only one magnet goes from on to off or vice versa at any given time. Bias helps assure that dither of the cab will not occur during periods requiring little or no correction.

The signals on lines 394 and 396 may be thought of as force command signals similar to the force command signal on line 150 in FIG. 7. Similarly, the controls 398, 400 provide actuator output signals on lines 402, 404 to actuators 356, 354, respectively, in a manner similar to the output signal on line 180 in FIG. 7.

In similar fashion each control 398, 400 provides position output signals 406, 408 corresponding to the gap signal on line 170 in FIG. 7.

For purposes of the position loop, both position signals on line 406, 408 and the corresponding, but opposite sided, rectification signal on lines 384, 378 are provided to a pair of FC-controlled clamp circuits 410, 412 for the purpose of selection of the valid position signal (both $P_+$ and $P_-$ provide position signals; however, only the position signal corresponding to the driven force generator is valid).

The outputs of the clamp circuits are provided to a summing junction 414 for the purpose of obtaining the valid position signal. Also provided to the summing junction 414 is an attenuated acceleration signal on a line 415 from an attenuator 415*a* responsive to the amplified acceleration signal on line 364.

Figure 22:
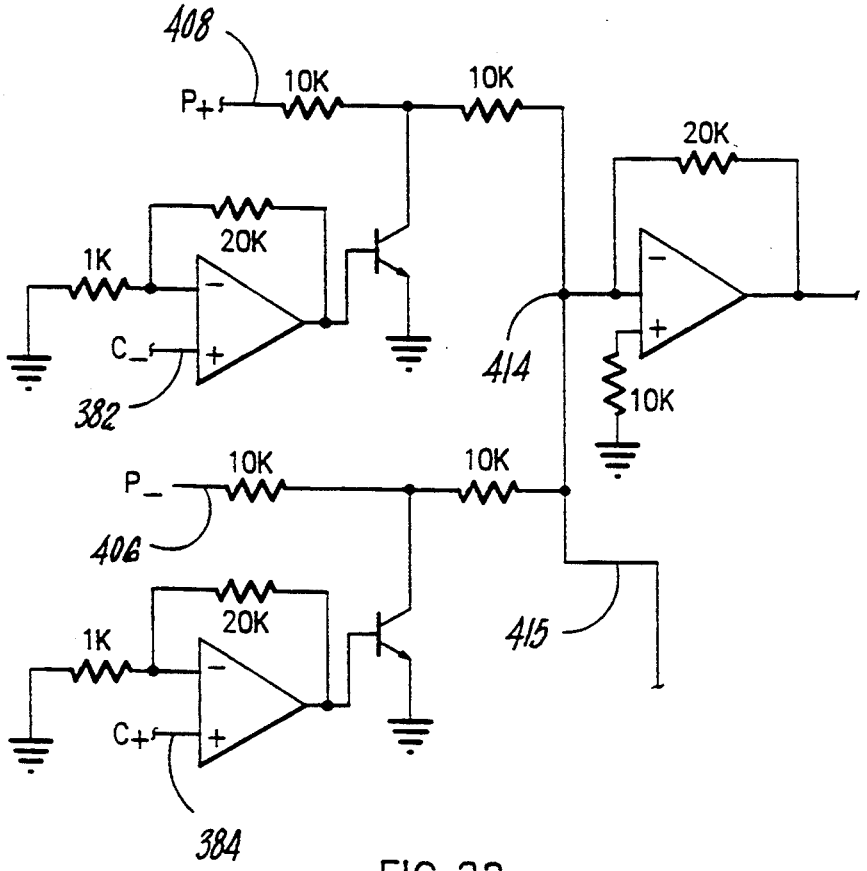
FIG. 22 illustrates an FC-controlled clamp circuit such as employed in the system of FIG. 18.

Both of the FC-controlled clamps 410, 412 and the summing junction 414 are shown in more detail in FIG. 22. The output of the summing Junction is a composite position and acceleration signal on a line 416 which is provided to a low pass filter 418 which has a time constant in the range of 1 to 10 seconds. The low pass filter 418 in turn provides the corrective signal on the line 370 to summing junction 366, previously described.

A single-axis control such as just described can be used in lieu of the 3-axis scheme described previously in connection with FIG. 2. However, the 3-axis scheme has many advantages. Among these are stabilization of all sensitive axes using a minimum number of electromagnets. Furthermore, the gap motion will be cosine $45^\circ = 0.707$ of the motion in the x or y direction. Thus, a plus or minus 15 mm gap variation for a single-axis or multiple-single-axis system reduces to a plus or minus 10.5 mm variation in the 3-axis scheme of FIG. 2. In FIG. 2, only four (4) electromagnets are used and, also, only four (4) power-electronic controllers are needed. Since magnets are used two-at-time in FIG. 2, magnet size can be reduced. Thus, use of magnets half the strength of those needed for the single-axis approach suffices for a commercially viable system.

When compared to the prior art mechanical restraints described in the background section, the present system is relatively cheap and is very rugged. The system can be used as a lock-up device during loading/unloading of passengers. Drifts in accelerometers are compensated using a slow-acting loop driven by position and acceleration signals without the need for separate transducers.

Although the invention has been shown and described with respect to an exemplary embodiment thereof, it should be understood that the foregoing and other changes, omissions and additions may be made therein and thereto, without departing from the spirit and scope of the invention.

We claim:

1. Apparatus for reducing horizontal acceleration of a suspended elevator cab comprising:

means (358) for sensing the acceleration and for providing an acceleration signal (360) having a magnitude indicative thereof;

positive and negative rectifier means (376, 374), responsive to the acceleration signal, for providing positive and negative acceleration signals (384, 378);

summing means (390, 388), respectively responsive to the positive and negative acceleration signals (384, 378) and responsive to a bias signal (392) for providing biased positive and negative acceleration signals; and a pair of opposed actuators (354, 356), respectively responsive to said biased positive and negative acceleration signal (384, 378) for exerting counterforces in proportion to said magnitude against said cab in a direction opposite that of said acceleration.

2. Apparatus for horizontally stabilizing an elevator in a hoistway, comprising:

three sensors for sensing horizontal translational movements of the elevator and for providing three sensed signals indicative thereof and wherein two of said three sensors are situated to sense translational movement along lines parallel to a single selected axis and wherein a single sensor of said three sensors is situated to sense translational movement along an axis perpendicular to said single selected axis;

control means, responsive to said three sensed signals, for computing corresponding forces required to counteract said sensed movements and for providing at least one control signal; and actuator means, responsive to said at least one control signal, for horizontally actuating the elevator in the hoistway.

3. Apparatus for horizontally stabilizing an elevator in a hoistway, comprising:

sensor means, responsive to a selected parameter associated with the elevator, for providing a sensed signal indicative thereof;

control means, responsive to said sensed signal, for providing a control signal; and actuator means, responsive to said control signal, for horizontally actuating the elevator, wherein said actuator means comprises four actuators situated to actuate the elevator along lines which intersect the elevator walls at an angle of forty-five degrees.

4. Apparatus for stabilizing an elevator in a hoistway, comprising:

sensor means, responsive to a selected parameter associated with the elevator, for providing a sensed signal indicative thereof;

control means, responsive to said sensed signal, for providing a control signal; and actuator means, responsive to said control signal, for horizontally actuating the elevator, wherein said actuator means comprises four actuators which each actuate the elevator along four separate lines intersecting walls of the elevator to form isosceles right triangles in corners of the elevator.

5. Apparatus for horizontally stabilizing an elevator in a hoistway, comprising:

sensor means, responsive to a selected parameter associated with the elevator, for providing a sensed signal indicative thereof;

control means, responsive to said sensed signal, for providing a control signal; and actuator means, responsive to said control signal, for horizontally actuating the elevator, wherein said actuator means comprises four actuators which each actuate the elevator along four separate lines intersecting one another to form a rectangle or square.

6. Apparatus for horizontally stabilizing an elevator in a hoistway, comprising:

sensor means, responsive to a selected parameter associated with the suspended cab, for providing a sensed signal indicative thereof;

control means, responsive to said sensed signal, for providing a control signal; and actuator means, responsive to said control signal, for horizontally actuating the elevator, wherein said actuator means comprises four actuators arranged in pairs, one pair at a time responsive to said control signal, each pair for actuating the elevator in opposing directions.

7. The apparatus of claim 6, wherein said four actuators comprise four electromagnets.

8. Apparatus for horizontally stabilizing an elevator in a hoistway, comprising:

sensor means,, responsive to a selected parameter associated with the elevator, for providing a sensed signal indicative thereof;

control means, responsive to said sensed signal indicative of the selected parameter, for providing a control signal; and actuator means, responsive to said control signal, for actuating the elevator for horizontally stabilizing the elevator in the hoistway, wherein said control means comprises first control means responsive to said sensed signal for providing a command signal and further comprises second control means responsive to said command signal and to at least one sensed signal indicative of the response of the elevator to said actuator means for providing a feedback signal to said first control means for providing said command signal.

9. The apparatus of claim 8, wherein said command signal is a force command signal and wherein said second control means is responsive to said force command signal from said first control means for exerting a commanded force against the elevator.

10. The apparatus of claim 9, wherein said second control means is responsive to a sensed signal indicative of the force exerted in response to said force command signal for comparison with said force command signal for providing a force command error signal.

11. The apparatus of claim 10, wherein said actuator means is an electromagnet and said sensed signal indicative of the force exerted in response to said force command signal is indicative of magnetic induction in a gap associated with said electromagnet and wherein the magnitude of said sensed signal is multiplied by a scale factor having dimensions of amperes per meter in order to provide said sensed signal as a force feedback signal for comparison with said force command signal.

12. The apparatus of claim 10, wherein said actuator means is an electromagnet, wherein said second control means is responsive to a sensed current signal indicative of the magnitude of current provided to the electromagnet by said control signal, and wherein said second control means is responsive to a sensed magnetic induction signal, for providing a position signal indicative of the position of the elevator.

13. The apparatus of claim 2, wherein said control means comprises:

means responsive to said sensed acceleration signals and to a position feedback signal for providing said at least one control signal as a force command signal; and wherein said control means further comprises:

means responsive to said force command signal for providing said position feedback signal.

14. The apparatus of claim 13, wherein said means responsive to said force command signal comprises:

means, responsive to an error signal indicative of the difference between the magnitude of said force command signal and a force feedback signal, for providing a thyristor firing signal;

a thyristor power converter, responsive to said firing signal, for providing a force actuation signal for causing said actuator to exert a force against the elevator;

divider means, responsive to a sensed current signal indicative of the magnitude of said force actuation signal and responsive to a sensed position signal indicative of the position of the elevator, for providing said position feedback signal; and means, responsive to said sensed position signal, for providing said force feedback signal.

15. The apparatus of claim 14, wherein said converter is a two-quadrant, full-wave thyristor converter.

16. A method for horizontally stabilizing an elevator suspended within a hoistway, comprising the steps of:

sensing the magnitude and direction of a selected parameter associated with the suspended elevator and providing a sensed signal having a magnitude and sign indicative thereof;

providing a control signal in response to said sensed signal; and horizontally actuating the suspended elevator in the hoistway in response to said control signal, wherein said step of sensing comprises the step of sensing translational movements of the elevator by providing said sensed signal as three sensed signals indicative thereof for providing said control signal as one or more control signals required to counteract movements indicated by said sensed signals, and wherein two of said three sensed signals are indicative of translational movement of the cab along lines parallel to a single selected axis and wherein a single sensed signal is indicative of translational movement along an axis perpendicular to said single selected axis.

17. The method of claim 16, wherein said movements indicated by said sensed signals are translational and rotational movement of the cab.

18. The method of claim 17, wherein said three sensed signals are indicative of accelerations present in said movements.

19. A method for horizontally stabilizing an elevator in a hoistway, comprising the steps of:

sensing the magnitude and direction of a selected parameter associated with the elevator and providing a sensed signal having a magnitude and sign indicative thereof;

providing a control signal in response to said sensed signal; and horizontally actuating the elevator in response to said control signal along lines which intersect the elevator walls at angles of forty-five degrees.

20. The method of claim 16, wherein said step of actuating comprises the step of actuating along four separate lines intersecting the walls of the elevator to form isosceles right triangles in corners of the elevator.

21. The method of claim 16, wherein said step of actuating comprises the step of actuating along four separate lines intersecting one another to form a rectangle or square.

* * * * *